US010690108B2

(12) United States Patent
Stöckle

(10) Patent No.: US 10,690,108 B2
(45) Date of Patent: Jun. 23, 2020

(54) METHOD FOR REGULATING THE SURFACE TEMPERATURE OF A GLOW PLUG

(71) Applicant: BorgWarner Ludwigsburg GmbH, Ludwigsburg (DE)

(72) Inventor: Jörg Stöckle, Ludwigsburg (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 0 days.

(21) Appl. No.: 16/033,930

(22) Filed: Jul. 12, 2018

(65) Prior Publication Data

US 2019/0017489 A1 Jan. 17, 2019

(30) Foreign Application Priority Data

Jul. 14, 2017 (DE) ..... 10 2017 115 917

(51) Int. Cl.
*F02P 19/02* (2006.01)

(52) U.S. Cl.
CPC ..... *F02P 19/025* (2013.01); *F02P 19/026* (2013.01)

(58) Field of Classification Search
CPC ..... F02P 19/025; F02P 19/026; F02P 19/023; G05D 23/19; G05D 23/2401; F02B 75/34; F02M 31/07; F02M 31/13; F02M 31/14; F02M 31/145; F02M 31/025
See application file for complete search history.

(56) References Cited

U.S. PATENT DOCUMENTS

| | | | | |
|---|---|---|---|---|
| 5,724,932 | A * | 3/1998 | Antone | F02P 19/021 123/145 A |
| 9,657,707 | B2 * | 5/2017 | Demmons | F02P 19/023 |
| 2008/0163840 | A1 * | 7/2008 | Toedter | F02P 19/026 123/145 A |
| 2009/0012695 | A1 * | 1/2009 | Kernwein | F02P 19/025 701/102 |
| 2011/0041785 | A1 | 2/2011 | Cassani | |
| 2011/0220073 | A1 * | 9/2011 | Sackmann | F02D 35/023 123/623 |
| 2011/0303649 | A1 * | 12/2011 | Sakurai | F02D 41/2432 219/263 |
| 2013/0238161 | A1 | 9/2013 | Sackmann | |

FOREIGN PATENT DOCUMENTS

| | | |
|---|---|---|
| DE | 10 2006 060 632 A1 | 6/2008 |
| DE | 10 2008 040 971 A1 | 2/2010 |
| DE | 10 2010 011 044 A1 | 9/2011 |
| DE | 10 2012 105 376 A1 | 9/2013 |

* cited by examiner

*Primary Examiner* — George C Jin
(74) *Attorney, Agent, or Firm* — Bose McKinney & Evans LLP

(57) ABSTRACT

A method for regulating the surface temperature of a glow plug is described, wherein the electrical resistance of the glow plug is continuously measured and used to regulate the surface temperature of the glow plug to a target temperature or a target resistance corresponding to the target temperature by means of a resistance temperature characteristic. According to this disclosure, it is provided that the resistance temperature characteristic used for the temperature regulation is adjusted as a function of the present motor operating state.

5 Claims, 1 Drawing Sheet

| | 0 | 25% | 50% | 75% | 100% |
|---|---|---|---|---|---|
| 900°C | 949mΩ | 965mΩ | 976mΩ | 988mΩ | 997mΩ |
| 1000°C | 1017mΩ | 1036mΩ | 1049mΩ | 1061mΩ | 1071mΩ |
| 1100°C | 1088mΩ | 1108mΩ | 1122mΩ | 1135mΩ | 1146mΩ |
| 1200°C | 1161mΩ | 1183mΩ | 1196mΩ | 1210mΩ | 1221mΩ |
| 1250°C | 1198mΩ | 1220mΩ | 1234mΩ | 1248mΩ | 1258mΩ |

| | 0 | 25% | 50% | 75% | 100% |
|---|---|---|---|---|---|
| 900°C | 949mΩ | 965mΩ | 976mΩ | 988mΩ | 997mΩ |
| 1000°C | 1017mΩ | 1036mΩ | 1049mΩ | 1061mΩ | 1071mΩ |
| 1100°C | 1088mΩ | 1108mΩ | 1122mΩ | 1135mΩ | 1146mΩ |
| 1200°C | 1161mΩ | 1183mΩ | 1196mΩ | 1210mΩ | 1221mΩ |
| 1250°C | 1198mΩ | 1220mΩ | 1234mΩ | 1248mΩ | 1258mΩ |

| | 0 | 25% | 50% | 75% | 100% |
|---|---|---|---|---|---|
| 900°C | 4,73V | 5,86V | 6,50V | 7,04V | 7,50V |
| 1000°C | 5,29V | 6,46V | 7,15V | 7,72V | 8,22V |
| 1100°C | 5,88V | 7,09V | 7,83V | 8,44V | 8,97V |
| 1200°C | 6,52V | 7,77V | 8,55V | 9,18V | 9,74V |
| 1250°C | 6,87V | 8,13V | 8,94V | 9,57V | 10,12V |

METHOD FOR REGULATING THE SURFACE TEMPERATURE OF A GLOW PLUG

RELATED APPLICATIONS

This application claims priority to DE 10 2017 115 917.7, filed Jul. 14, 2017, the entire disclosure of which is hereby incorporated herein by reference.

BACKGROUND

This disclosure relates to a method for regulating the surface temperature of a glow plug by closed-loop control. One known method for regulating surface temperature of a glow plug is disclosed in DE 10 2012 105 376 A1.

In such methods, a target resistance is determined from a target temperature by means of a resistance temperature characteristic of the glow plug, and the actual resistance of the glow plug is then regulated to the target resistance by closed-loop control. By means of a resistance temperature characteristic, a target value of the electrical resistance is associated with a target value of the temperature and the supply of electrical power to the glow plug is regulated so that the electrical resistance and the temperature associated with it are brought into conformity with the target value of the electrical resistance or with the target value of the temperature. The quality of the temperature regulation is limited by the accuracy of the resistance temperature characteristic. It is therefore important to know the resistance temperature characteristic of the glow plug used as precisely as possible.

One option for determining the resistance temperature characteristic of a glow plug is to keep the motor at standstill for a few minutes and then to heat the glow plug for a certain time, e.g., for about one minute, with a constant predetermined electric power until the glow plug reaches an equilibrium state, the temperature of which is defined by the heating power and heat dissipation with the motor at standstill and is therefore known or can be determined by appropriate measurements for all future cases.

In practice, it has been found that when regulating the surface temperature of a glow plug, even when using a precisely determined resistance temperature characteristic, considerable control deviations can occur, which can easily amount to 50 K.

SUMMARY

This disclosure shows a way in which the accuracy of the regulation of the surface temperature of a glow plug can be further improved.

In a method according to this disclosure, the resistance temperature characteristic used for the temperature regulation is adjusted as a function of the present motor operating state. In this way, the surface temperature of a glow plug can be regulated by closed-loop control to a target value with a substantially greater accuracy.

This is attributed to the fact that the total resistance of a glow plug, which the resistance temperature characteristic associates with a temperature, is substantially determined by the temperature of the heat conductor and that the surface temperature of the glow plug does not coincide with the temperature of the heat conductor in all cases. As a rule, the heat conductor does not have a homogeneous temperature in this case, but rather warmer and colder regions, so that its resistance is determined by a spatially averaged temperature, which may differ considerably from the surface temperature.

The surface of the glow plug is cooled, for example, by the air-fuel mixture introduced in each motor cycle or heated by combustion thereof, so that significant deviations of the surface temperature from the temperature of the heat conductor or the spatially averaged temperature of the heat conductor can result. These deviations depend on the motor operating state. Therefore, by adjusting the resistance temperature characteristic used as a function of the present motor operating state, the quality of the regulation of the surface temperature can be improved.

The motor operating state can be characterized, for example, by the rotational speed and/or the load state. Thus, one option to implement this disclosure is that the glow plug control device is informed by the motor control device or its own sensors continuously about the motor operating state, for example, the motor rotary speed and/or the motor load. Using the communicated motor operating state, the glow plug control device can then, for example, make a correction of the resistance temperature characteristic from a characteristic diagram or a table, i.e., adjust the target resistance value belonging to a given target temperature.

However, the effort to inform a glow plug control device of the motor operating state via the motor control device or separate sensors is considerable. An advantageous refinement of this disclosure therefore relates to a way in which this considerable effort can be avoided. To this end, the adjustment of the resistance temperature characteristic used for the temperature regulation as a function of the present motor operating state is made by the glow plug control device by comparing the electric power required for maintaining a target temperature with an expected value that is required to maintain this target temperature at a defined motor operating state, and by inferring from the magnitude of a deviation detected in this case the magnitude of the adjustment to be made of the target resistance belonging to the present target temperature.

The defined reference motor operating state may be an idling state, i.e., a motor load of 0%. A resistance temperature characteristic is stored for this defined reference motor operating state in the glow plug control device. This resistance temperature characteristic may be stored by the manufacturer in the glow plug control device or have been previously determined by the glow plug control device itself, for example, by evaluating the heating behavior or by feeding a defined power into the glow plug for a period of about one minute with the motor at standstill, as described above.

In addition, data is stored in the glow plug control device, the data indicating the amount of electrical power needed to maintain a given target temperature of the surface of the glow plug at this reference motor operating state. If the glow plug control device now determines that another power, for example a 10% greater electrical power, is required to maintain the target resistance, which belongs to this temperature according to the resistance temperature characteristic, it can be inferred that the present motor operating state deviates from the defined reference motor operating state.

The magnitude of adjustment required to compensate for the influence of the motor operating state on the surface temperature can be determined from the magnitude of the detected deviation of the electrical power required to maintain the target resistance from the expected value for the reference motor operating state. This adjustment can be made, for example, with a characteristic diagram.

Instead of comparing the applied electrical power with an expected value of the power, one can also consider the voltage applied to the glow plug on average over time. For this purpose, a value of the voltage can be stored in the glow plug control device, that value having to be applied in the reference motor operating state over time to the glow plug, so that it maintains a target resistance. If a greater or lesser voltage must be applied to the glow plug on average over time so that the resistance of the glow plug corresponds to the target resistance, it can also be inferred from this that the present operating state of the motor deviates from the reference state. The size of the adjustment which is required to compensate the influence of the motor operating state on the surface temperature can thus be inferred from the magnitude of the deviation of the voltage required on average over time for maintaining a target resistance from a voltage required for this target resistance in the reference motor operating state. The magnitude of the adjustment can be determined, for example, with a characteristic diagram.

Glow plugs are usually heated by pulse width modulation. The voltage or power required to maintain a resistance on average over time can be determined very quickly, typically in fractions of a second.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

Figures 1, 2, 3:
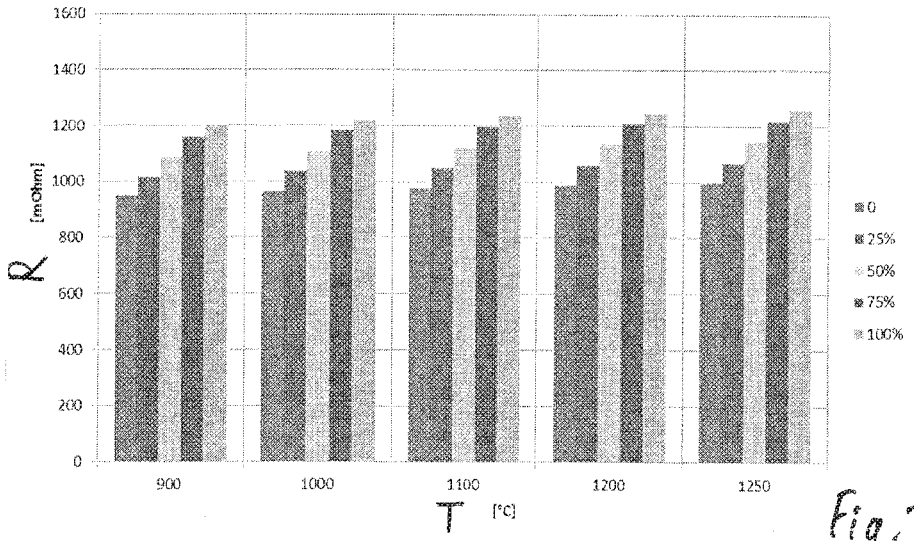
FIG. 1 is a bar graph that indicates the resistance R in mΩ for various surface temperatures of a glow plug respectively for different load states of the motor.
FIG. 2 is a table that indicates, by example, the electric resistance, in mΩ, of the glow plug belonging to the respective surface temperature at various load states of the motor for various surface temperatures of a glow plug.
FIG. 3 is a table that indicates, by example, various surface temperatures of a glow plug, the effective voltages required to maintain the respective surface temperature in V at different load states of the motor.

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

In FIG. 1, the electric resistance for a glow plug is specified as a bar graph in mΩ for surface temperatures of 900° C., 1,000° C., 1,100° C., 1,200° C. and 1,250° C. at different load states of the motor, namely respectively from left to right for 0%, 25%, 50%, 75% and 100% motor load. FIG. 1 clearly shows that the resistance of a glow plug can change by about 20% at a constant surface temperature as a function of the motor operating state. In this context, it should be noted that glow plugs react differently to changes of the motor operating state, depending on the type. The example of FIG. 1 therefore does not indicate any generally valid changes of the resistance of a glow plug as a function of the motor operating state, but rather merely illustrates that the motor operating state influences the resistance. The magnitude of the influence of the motor operating state on the resistance of the glow plug is different for each glow plug type and each glow plug model. The corresponding data for an adjustment of the resistance temperature characteristic to the motor operating state should therefore be determined separately for each glow plug model.

FIG. 2 shows the data illustrated in FIG. 1 in the form of a table, wherein the entries in the table indicate the resistance of the glow plug in mΩ for the different load states of the motor and the different surface temperatures. It can clearly be seen therein that the greater the resistance of the glow plug, which resistance belongs to a given surface temperature, the greater the load state of the motor.

FIG. 3 correspondingly shows a table which indicates the voltage in volts required to maintain a surface temperature of the glow plug for various load states of the motor. In this case, FIG. 3 clearly shows that the voltage which has to be applied to the glow plug in order to maintain a given surface temperature, for example, a surface temperature of 1,200° C., increases with increasing load state of the motor.

The figures explained above make it clear that, for a precise regulation of the surface temperature by closed-loop control, the present motor operating state must be taken into account, that is, the resistance temperature characteristic used for closed-loop control of the temperature must be adjusted as a function of the present motor operating state.

The glow plug control device could make this adjustment by the motor control device or a corresponding sensor communicating the present motor operating state to it. However, the related effort can be avoided by the glow plug control device monitoring the power or voltage that is required to maintain the resistance associated with a given target temperature according to the resistance temperature characteristic used.

For temperature regulation, i.e., closed-loop control, the glow plug control device in this case initially uses a resistance temperature characteristic which was determined for a defined reference state of the motor, for example, for a motor load of 0%. If the glow plug control device is then to maintain a target temperature of, for example, 1,200° C., the glow plug control device will first regulate the resistance of the glow plug to a value of 1,161 mΩ, since this is the resistance value which, according to FIG. 2, is associated with the target temperature of 1,200° C. at the reference motor operating state, for example, a motor load of 0%. If the motor load is higher than 0%, that is, 75%, for example, the resistance value of 1,161 mΩ corresponds only to a temperature value of about 1,150° C., which can be determined by interpolation of the values of the corresponding column of FIG. 2.

At a motor load of 75%, however, a value of about 8.8 V belongs to a temperature value of about 1,150° C., which can be seen by interpolation of the corresponding column of FIG. 3. Instead of the expected 6.52 V, the glow plug control device thus recognizes that approximately 8.8 V are required to maintain the resistance of 1,161 mΩ. With a characteristic diagram on the basis of the data shown in FIGS. 2 and 3, the glow plug control device can determine therefrom the load state of the motor and determine the electrical resistance belonging to the target temperature at this load state and regulate this, thus, for example, to 1,210 mΩ instead of to 1,161 mΩ. The glow plug control device thus adjusts the resistance temperature characteristic used for the temperature regulation as a function of the present motor operating state and thus achieves a substantially more precise control of the surface temperature.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A method for regulating the surface temperature of a glow plug, comprising:

continuously measuring electrical resistance of the glow plug;

using the continuously measured resistance and a resistance temperature characteristic to regulate the surface temperature of the glow plug to a target temperature or a target resistance corresponding to the target temperature; and adjusting the resistance temperature characteristic as a function of the present motor operating state, wherein the present motor operating state is determined by a glow plug control device monitoring the power or voltage that is required to maintain the resistance associated with a given target temperature according to the resistance temperature characteristic used.

2. The method according to claim 1, wherein the motor operating state is defined by rotational speed and/or load state.

3. The method according to claim 1, wherein:

the magnitude of the adjustment is inferred.

4. The method according to claim 3, wherein the adjustment is made with a characteristic diagram.

5. The method according to claim 3, wherein the defined reference motor operating state is an idling state.

* * * * *